US010589410B2

(12) United States Patent
Aho

(10) Patent No.: US 10,589,410 B2
(45) Date of Patent: Mar. 17, 2020

(54) HAMMER DRILL ADAPTORS AND METHODS OF USE

(71) Applicant: Ronald Aho, Marquette, MI (US)

(72) Inventor: Ronald Aho, Marquette, MI (US)

( * ) Notice: Subject to any disclaimer, the term of this patent is extended or adjusted under 35 U.S.C. 154(b) by 342 days.

(21) Appl. No.: 15/647,857

(22) Filed: Jul. 12, 2017

(65) Prior Publication Data

US 2018/0043520 A1 Feb. 15, 2018

Related U.S. Application Data

(60) Provisional application No. 62/373,466, filed on Aug. 11, 2016.

(51) Int. Cl.
*B25D 17/02* (2006.01)
*B25D 17/08* (2006.01)

(52) U.S. Cl.
CPC ..... *B25D 17/02* (2013.01); *B25D 17/08* (2013.01); *B25D 2217/0003* (2013.01)

(58) Field of Classification Search
CPC ..... B25B 21/00; B25B 21/007; B25D 17/06; B25D 2217/0019; B25D 17/00; B25D 17/02; B25D 17/08; B25D 2217/0003; B25D 2250/141; B25D 17/005; B25D 2217/0007
USPC ..... 173/1, 2, 29, 130–133, 176, 179, 183, 173/217; 227/56–58, 119–120, 123–129, 227/132–139
See application file for complete search history.

(56) References Cited

U.S. PATENT DOCUMENTS 3,216,734 A * 11/1965 Thompson ..... B25D 17/005 279/44
3,823,624 A * 7/1974 Martin ..... B25B 13/461 81/58.1
4,323,127 A * 4/1982 Cunningham ..... B25C 1/06 124/78
4,541,160 A * 9/1985 Roberts ..... F16C 1/02 29/401.1
4,826,136 A * 5/1989 Thomas ..... B25C 11/00 254/131
4,896,892 A * 1/1990 Andrews ..... B23B 31/1075 279/145
5,219,378 A * 6/1993 Arnold ..... B26B 7/00 156/763
5,427,188 A * 6/1995 Fisher ..... B25D 11/102 173/205

(Continued)

*Primary Examiner* — Robert F Long
(74) *Attorney, Agent, or Firm* — Device Patent LLC

(57) ABSTRACT

A hammer drill adapter for driving a drive cleat to join opposed ends of a duct comprising: a first portion generally aligned in a plane; a shaft portion having an elongate axis generally parallel to said plane; the first portion fixed to the shaft portion; an entry surface at a distal end of the first portion; a capture cavity extending through the entry surface; the capture cavity defined proximally by a rear surface and by an opposed lower and upper capture surfaces; the capture cavity also laterally defined by an opposed first capture surface and a second capture surface; the capture cavity sized to house a trailing end portion of a drive cleat; and wherein the shaft portion comprises a connection portion at a proximal end of said shaft portion for fixation within a hammer drill chuck. Also disclosed are methods for use to advance a drive cleat.

20 Claims, 14 Drawing Sheets

(56) References Cited

U.S. PATENT DOCUMENTS 5,469,623 A * 11/1995 Roeker ..... B26B 7/00 30/169
5,485,769 A * 1/1996 Olson ..... B25B 15/001 81/177.85
5,509,333 A * 4/1996 Rion ..... B25B 13/461 81/177.85
5,513,709 A * 5/1996 Fisher ..... B25D 11/08 173/170
5,833,014 A * 11/1998 Dunn ..... B23D 57/0076 173/162.2
6,120,220 A * 9/2000 Speare ..... B23B 51/05 408/1 R
6,120,363 A * 9/2000 Dunn ..... B24B 23/04 15/22.2
D450,992 S * 11/2001 Abshire ..... D8/14
6,427,564 B1 * 8/2002 Nelson ..... B25G 1/005 81/177.1
6,485,495 B1 * 11/2002 Jenkinson ..... A61B 17/1604 606/167
6,598,775 B1 * 7/2003 Chen ..... B25C 7/00 227/113
6,755,597 B2 * 6/2004 Bergner ..... B23Q 7/10 144/136.95
7,096,972 B2 * 8/2006 Orozco, Jr. ..... B25D 11/102 173/114
7,159,491 B1 * 1/2007 Chaconas ..... B25B 13/06 81/124.3
D545,648 S * 7/2007 Pulling ..... D8/14
7,765,631 B2 * 8/2010 Fisher ..... B23Q 5/027 15/236.01
7,980,321 B2 * 7/2011 Happ ..... B25B 23/0035 173/128
8,397,471 B2 * 3/2013 Jones ..... E04F 21/22 254/104
8,910,360 B1 * 12/2014 Keetle ..... B23B 51/0054 29/402.08
9,180,584 B1 * 11/2015 Cook ..... B25B 33/00
9,670,042 B2 * 6/2017 Liou ..... B66F 15/00
9,702,153 B2 * 7/2017 Kehoe ..... E04F 21/0084
2003/0041704 A1 * 3/2003 Pelt ..... B25B 21/02 81/466
2007/0193430 A1 * 8/2007 Jang ..... G10D 3/006 84/313
2009/0084567 A1 * 4/2009 Basham ..... B25C 7/00 173/29
2010/0018365 A1 * 1/2010 Tyler ..... B25B 5/12 81/423
2010/0019014 A1 * 1/2010 Rodenhouse ..... B25B 21/002 227/32
2012/0255749 A1 * 10/2012 Seith ..... B25B 13/06 173/1
2013/0161038 A1 * 6/2013 Prunean ..... B25B 21/007 173/1
2015/0217431 A1 * 8/2015 Seith ..... B25B 13/06 81/121.1
2015/0217433 A1 * 8/2015 Seith ..... B25B 23/0035 81/124.6
2017/0297178 A1 * 10/2017 Hsieh ..... B25B 21/02
2018/0141190 A1 * 5/2018 Prunean ..... B25B 31/00
2018/0304452 A1 * 10/2018 Rittenhouse ..... B25F 1/006

* cited by examiner

HAMMER DRILL ADAPTORS AND METHODS OF USE

CROSS REFERENCE TO RELATED APPLICATIONS

This application claims priority to Provisional Patent Application No. 62/373,466 filed Aug. 11, 2016, the entire disclosure of which is hereby incorporated by reference and relied upon.

BACKGROUND OF THE INVENTION

Field of the Invention

The invention relates generally to adaptors for use in hammer drills, and more particularly to hammer drill adaptors and their methods of use for driving a drive cleat to join together air ducts at a seam.

Description of Related Art

In HVAC and other air flow systems, both the air ducts and drive cleats are typically galvanized steel and/or aluminum in construction. Drive cleats are used to join sections of rectangular ducts in HVAC and other air flow systems. Ducts are configured to have a lip, indentation or other bracket to connect the drive cleat to the ducts.

A common handheld hammer is used to impact a drive cleat to connect air ducts together. Since air ducts are typically overhead, sheet metal workers typically stand on a ladder to drive the cleat. Using a repetitive upward shoulder force, the user swings a hammer impacting one end of the drive cleat so as to force it into position connecting the ducts. However, this method is time consuming, difficult to maneuver and may lead to bent drive cleats during the installation process. In addition, this repetitive manual impact motion is known to cause shoulder injuries.

What is needed are improved tools and methods of installing drive cleats. These tools and methods should reduce the time required to safely install a drive cleat, be easy to maneuver, and must reduce the impact forces experienced by the shoulders of sheet metal workers during installation.

SUMMARY OF THE INVENTION

Hammer drills are known in the art and configured to perform a hammering action. Hammer drills, also known as a rotary hammers or hammering drills are a rotary drill with a hammering action. The hammering action is typically used to provide a short, rapid hammer thrust to pulverize relatively brittle material and provide quicker drilling with less effort. These tools are usually electrically powered, and increasingly powered by two batteries. Disclosed are novel adaptors for use within hammer drills and configured for coupling with a drive cleat whereby the powered action of the hammer drill is transferred through a novel drive cleat adaptor to drive a drive cleat for simplified and safe duct connection.

In one form, a hammer drill drive cleat adaptor (also referred to hammer drill adaptor, drive cleat adaptor, adaptor, or alternate spelling adapter) is configured at one end to be releasably fixed within a standard hammer drill chuck, and configured at an opposing end to releasably hold a standard drive cleat.

In one form, a hammer drill adaptor enables a user to use a hammer drill, instead of a common hammer, to install a drive cleat thereby saving time and effort and injury during installation.

In one form, a drive cleat adaptor includes a shaft portion configured to connect directly to a hammer drill.

In one form, drive cleat adaptors comprise a generally rectangular first portion configured to house a trailing portion of a standard drive cleat.

In one form, a first portion of a drive cleat adaptor includes a flange adapted to bias against a drive cleat during installation to force the drive cleat into position thereby connecting air ducts together at a seam.

In one form, a first portion of a drive cleat adaptor includes a capture cavity which may include an open slot.

In one form, an open slot (when present) in a drive cleat adaptor comprises an opposed first side wall and second side wall spaced from each other.

In one form, side walls of an open slot of a drive cleat adaptor terminate at a rear wall wherein the rear wall has a rear surface thereon. The rear wall may also be known as a flange.

In one form, a rear wall includes a generally planar rear surface although the rear surface may be non-planar.

In one form, a rear surface is configured to abut an end portion of a drive cleat during installation thereby transferring impact forces to the drive cleat.

In one form, an open slot is generally elongate and extends along a majority of a first portion beginning at an entry surface on an entry wall.

In one form, a first portion is generally aligned in a plane and includes an upper surface and a lower surface.

In one form, each of an upper surface and a lower surface are generally planar and dimensioned to accommodate a standard drive cleat located within a capture cavity located therebetween.

In one form, a secondary surface is positioned proximal from an entry surface yet distal to a rear surface.

In one form, a secondary surface is parallel to an entry surface.

In one form, a lower capture surface is extended further distally than said upper capture surface and first and second capture surfaces of a capture cavity.

In one form, a first portion includes an interface portion connecting to a shaft portion.

In one form, an interface portion includes tapered side portions extending towards a shaft portion.

In one form, a first portion includes an opposing first side wall and second side wall defining a first portion with a generally rectangular configuration.

In one form, a capture cavity is defined by a lower capture surface and opposing upper capture surface, and laterally by a first capture surface and a second capture surface, and is enclosed proximally by a rear surface on a rear wall.

In one form, a capture cavity is open to provide for insertion of a drive cleat into a distal end.

In one form, a capture cavity is dimensioned in size and shape and otherwise configured to house a standard drive cleat.

In one form, a capture cavity is fashioned in various sizes suited to house alternative drive cleats.

In one form, a slot within a first portion is dimensioned to accommodate a standard drive cleat in a rotated orientation. A drive cleat is turned sideways and a narrow portion of the drive cleat is slid within the slot.

In one form, a drive cleat is positioned against an entry surface at a distal end of a first portion so as to transmit a force from a hammer drill to the entry surface to drive a drive cleat.

In one form, a shaft portion is generally cylindrical in shape and connected to a first portion at an interface portion.

In one form, a proximal end of a shaft portion includes various connection structures configured to fix the shaft portion in a hammer drill chuck of a hammer drill.

In one form, a shaft portion comprises a rounded shaft surface extending around a majority of the shaft portion.

In one form, a distal end of a shaft portion joins a first portion.

In one form, a shaft portion is welded directly to a first portion at an interface portion.

In one form, a shaft portion is adhered by an adhesive, bolted or otherwise fixed to a first portion.

In one form, a drive cleat adapter including both a first portion and a shaft portion are formed as a one piece configuration by means of a mold or extrusion.

In one form, a shaft portion is generally aligned along its elongate axis and includes one or more of a first connection portion and a second connection portion.

In one form, there are two of each of first connection portions and second connection portions which are spaced apart and on opposing sides of a shaft portion.

In one form, a first connection portion is in the form of an indentation on a shaft surface of shaft portion and is dimensioned to accommodate a standard hammer drill chuck.

In one form, a first connection portion includes a spaced apart first end and second end wherein the spaced ends are generally rounded and closed and adapted to cooperate with a hammer drill chuck.

In one form, when a hammer drill chuck is locked on one or more of a first connection portion and a second connection portion of a shaft portion, the shaft portion cannot escape when the hammer drill is operating.

In one form, a second connection portion is in the form of an elongated slot formed on an outer surface of a shaft portion. The slot of the second connection portion includes a closed end and an open end. The slot of the second connection portion is also configured to connect with the chuck of a hammer drill.

In one form, a shaft portion of a hammer drill adaptor is configured with at least one standard hammer drill connection from the group of SDS, SDS-Plus, SDS-Max, Straight Shank, and Spline Shank.

In one form, a bore or small indentation is provided at a proximal end of a shaft portion. The bore may also be adapted to connect directly to a hammer drill during use.

In one form, a first portion rear wall has a generally planar rear surface (although this surface may be non-planar in alternative embodiments).

In one form, a drive cleat abuts a rear surface of a rear wall during use. The rear wall and rear surface are used to bias against an trailing end portion of the drive cleat when in both the standard and rotated installation positions.

In one form, an adaptor comprises an assembly of parts.

In one form, a drive cleat adaptor assembly comprises a first portion, a shaft portion, a cover portion, and one or more cover fasteners.

In one form, a first portion is divided to include a cover portion that mates with a first portion to form a capture cavity.

In one form, one or more cover fasteners extend through fastener holes in a cover portion to thread into threaded holes extending through the body of a first portion.

In one form, the fastener holes in a cover portion are counter sunk.

In one form, a first capture surface, a second capture surface, a lower capture surface, an upper capture surface, and a rear surface generally define a capture space for containing a drive cleat therein.

In one form, a distal end of a shaft portion is seated against a channel surface in a shaft channel located in an interface portion of the first portion.

In one form, an upper capture surface compresses against a lock flat when cover fasteners are advanced.

In one form, a cover portion comprises a lock boss extending from an upper capture surface which seats in a lock recess of a shaft portion when assembled to fix the shaft portion to the first portion.

In one form, a drive cleat adaptor comprises a drive cleat retension member. A drive cleat retension member adds the additional functional benefit of releasably holding a drive cleat in a capture cavity thereby preventing unintentional drop out of the drive cleat from a capture cavity if the user tilts the hammer drill to the side or downwards for any reason.

In one form, a spring foot of a spring is sandwiched between an upper capture surface of a cover portion and lower capture surface of a first portion.

In one form, a spring foot comprises one or more spring holes for the passage of one or more cover fasteners.

In one form, a spring cutaway may be included for clearance of a cover boss.

In one form, extending from a spring foot is a distal portion of a spring comprising a deflection arm with a contact face for abutting against a drive cleat to create a friction fit within a capture cavity.

In one form, the spring force through a deflection arm is sufficient to hold a drive cleat within capture cavity against gravity, however the drive cleat is easily removed when a distraction force is applied by a user.

In one form, an elongate spring channel may be formed in a cover portion to house a spring end thereby preventing interference between a drive cleat and the spring end during drive cleat insertion into a capture cavity.

In one form, a drive cleat retension member may assume other resilient forms such as springs of various shapes and configurations and elastomeric materials such as a rubber or foam pad.

In one form, an adaptor includes a drive cleat retension member in the form of one or more magnets.

In one form, an adaptor comprises one or more magnet bores that extend into a lower capture surface of a first portion.

In one form, magnet bores are defined by one or more of a base face and a position face.

In one form, one or more magnet bores are sized and shaped to accommodate disc shaped magnets.

In one form, one or more magnets are held in magnet bores by adhesives.

In one form, one or more magnets and cooperating magnet bores may assume a variety of shapes and sizes.

In one form, one or more magnet bores may be formed in other surfaces defining a capture cavity such as within an upper capture surface of a cover portion.

In one form, upon insertion of a drive cleat of a material such as steel into a capture cavity, one or more magnets are magnetically attracted to the drive cleat causing it to be held within a capture cavity against gravity. The drive cleat may be removed with a translation force by the user.

In one form, a drive cleat adaptor comprises a capture cavity having various degrees of enclosure.

In one form, a slot portion extends entirely through a first portion of an adaptor.

In one form, a capture cavity is only substantially enclosed at a distal and proximal ends of a capture cavity.

In one form, only a proximal end of a capture cavity is enclosed. For example, a magnet bore houses a robust magnet that substantially controls the position of a drive cleat by means of magnetic attraction at a location distal of the proximal end.

A hammer drill drive cleat adaptor, including both first portion and shaft portion, may be made of any suitable metal having sufficient strength and resiliency to withstand the force from both a hammer drill and the drive cleat. An adaptor may be made from steel, aluminum or any other suitable metal or alloy. Alternatively, an adaptor may be plastic, polymer or rubber material or combination of materials so long as said material has sufficient strength and resiliency to withstand the force from both the hammer drill and the drive cleat.

In one form, a method of using a hammer drill adaptor to install a drive cleat to join air ducts comprises the steps of: obtaining a drive cleat suited to join two adjacent air ducts along a seam; obtaining a hammer drill having a hammer drill chuck; obtaining a hammer drill adapter having a shaft portion and a first portion where said shaft portion extends from said first portion and wherein said first portion has a generally rectangular shaped capture cavity extending proximally from a distal end of said hammer drill adaptor and wherein said capture cavity terminates at a rear surface; securing of portion of said shaft portion of the hammer drill adapter in the hammer drill chuck; engaging the hammer drill chuck within one or more of a first and second connection portion of a hammer drill adaptor; inserting a trailing end of said drive cleat into said capture cavity until a terminal end of the drive cleat abuts said rear surface of said drive cleat at a proximal end of said capture cavity; positioning the hammer drill with drive cleat seated in the capture cavity to a seam of adjacent air ducts; joining the leading end of the drive cleat to a seam joining a first duct and second duct; actuating the hammer drill to exert a plurality of pulses; advancing said hammer drill adapter by application of a force generally along a central axis of said shaft portion thereby driving said drive cleat into an installed position wherein the drive cleat joins together the first and second duct. A next step comprises withdrawing said hammer drill adaptor, hammer drill chuck, and hammer drill from said drive cleat after the drive cleat is in an installed position. In the event the drive cleat requires to be driven further, a next step comprises the step of removing the drive cleat from the capture cavity and repositioning it approximately 90 degrees within a slot extending through an upper surface and an upper capture surface of said hammer drill adaptor. The user then finishes installation of the drive cleat to further push the drive cleat into a fully installed position. Again, if further driving of the drive cleat is required, the user may position an entry surface at a distal end of a first portion of the adapter against the trailing end of the drive cleat so as to exert a force against the distal end of the drive cleat. This step provides the user a method to gently tap the drive cleat into a final installed position.

In one form, a method of using a hammer drill adaptor to remove a drive cleat comprises the steps of: obtaining a hammer drill having a hammer drill chuck; obtaining a hammer drill adapter having a shaft portion and a first portion where said shaft portion extends from said first portion and wherein said first portion has a generally rectangular shaped capture cavity extending proximally from a distal end of the hammer drill adaptor and terminating at a rear surface; securing the shaft portion of the hammer drill adapter in the hammer drill chuck; bending a free end of a drive cleat towards an opposing end of the drive cleat; positioning the free end of the drive cleat within the capture cavity against the rear surface at a proximal end of said capture cavity; and actuating the hammer drill to exert a plurality of pulses thereby driving the drive cleat into an uninstalled position removed from the seam.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF SELECTED EMBODIMENTS OF THE INVENTION

Figure 1:
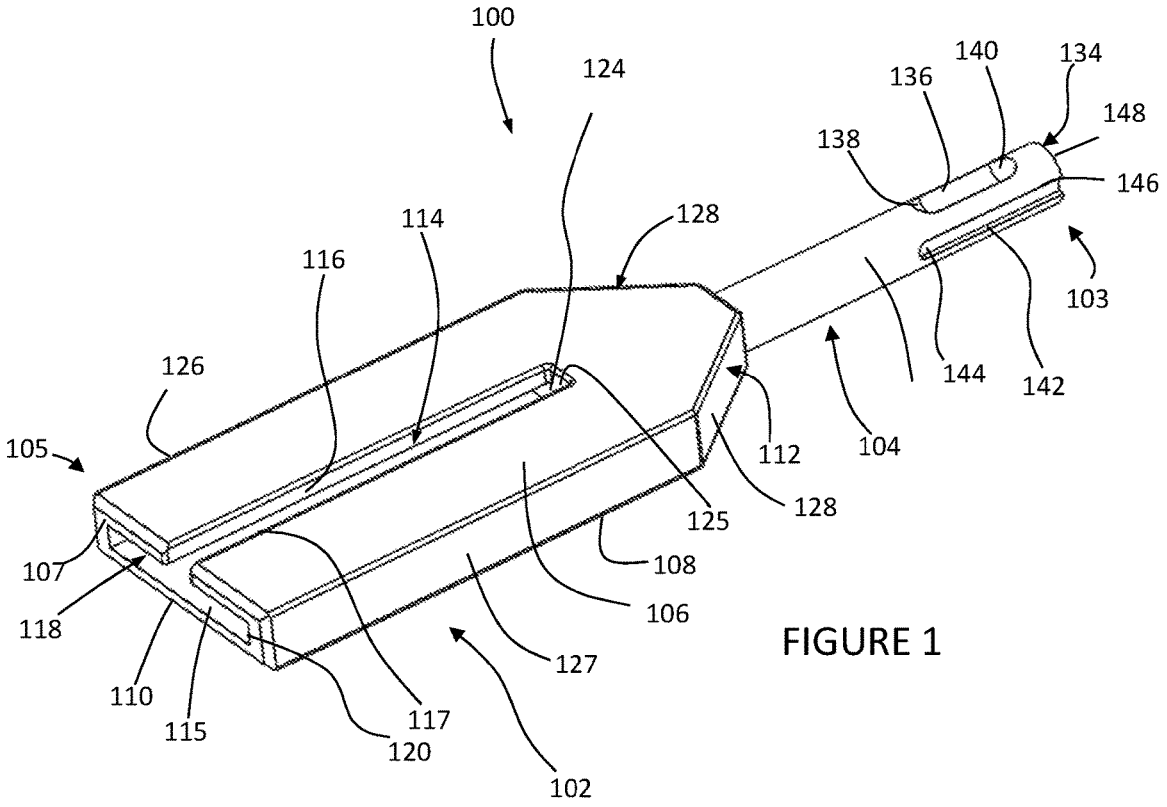
FIG. 1 depicts a perspective view of a drive cleat adaptor for connection to a hammer drill according to one or more embodiments shown and described herein.

Select embodiments of the invention will now be described with reference to the Figures, wherein like numerals reflect like elements throughout. Various depicted embodiments having like numerals are distinguished using a letter in addition to the numeral. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

In one embodiment (FIGS. 1-7), an adaptor is configured to be releasably fixed to a standard hammer drill at one end and to releasably hold a standard drive cleat at an opposing end. The adaptor enables a user to use a hammer drill, instead of a common hammer to install a drive cleat, thereby saving time and effort and prevention of injury during installation. A drive cleat adaptor 100 includes a first portion 102 configured to connect directly to a hammer drill at a shaft portion 104. In preferred embodiments, drive cleat adaptors 100 comprise a generally rectangular first portion 102 configured to house the trailing end of a standard drive cleat. The first portion 102 includes a flange 124 adapted to bias against the drive cleat during installation to force a drive cleat into position thereby connecting air ducts together at a seam. Accordingly, in this embodiment, a first portion 102 includes a capture cavity 118 which may include an open slot 114.

The open slot 114 (when present) comprises an opposed first side wall 116 and second side wall 117 spaced apart from each other. The side walls terminate at a rear wall 124 with a rear surface 125 thereon. The rear wall 124, also known as a flange, includes a generally planar rear surface 125 although the rear surface may be non-planar. Rear surface 125 is configured to abut an end portion of a drive cleat during installation thereby transferring impact forces to the drive cleat. An open slot 114 (when present) is generally elongated and extends along a majority of the first portion 102 beginning at an entry surface 107 on an entry wall 110.

First portion 102 aligned generally in a plane B (FIG. 1B) includes an upper surface 106 and a lower surface 108. Each of the upper surface 106 and the lower surface 108 in this embodiment are generally planar and dimensioned to accommodate a standard drive cleat within a capture cavity 118 therein. First portion 102 includes an interface portion 112 connecting to shaft portion 104. Interface portion 112 in this embodiment includes tapered side portions 128 extending towards shaft portion 104. First portion 102 further includes opposing first side wall 126 and second side wall 127 thereby defining first portion 102 with a generally rectangular profile although other profiles may be assumed.

In this embodiment, capture cavity 118 is defined by a lower capture surface 115 and opposing upper capture surface 109, and laterally by first capture surface 119 and second capture surface 120, and is enclosed proximally by rear surface 125 on rear wall 124. At a distal end 105, capture cavity 118 is open to provide for insertion of a drive cleat. Capture cavity 118 is dimensioned in size and shape and otherwise configured to house a standard drive cleat as illustrated in FIG. 1B wherein a drive cleat is prepared to be housed in capture cavity 118. In alternative embodiments, capture cavity 118 is fashioned in various sizes suited to house alternative drive cleats. Slot 114 is dimensioned to accommodate a standard drive cleat in a rotated orientation as illustrated in FIG. 1C. In this configuration, a drive cleat 204 is turned sideways generally 90 degrees and a narrow portion of the drive cleat is slid within the slot 114 or the drive cleat is positioned against entry surface 107 at distal end 105 so as to allow a hammer drill 200 to exert a force against entry surface 107.

Shaft portion 104 is generally cylindrical in shape and connected to first portion 102 at interface portion 112. Proximal end 134 includes various connection structures configured to seat shaft portion 104 directly in a hammer drill chuck 202 of a hammer drill 200. Shaft portion 104 comprises a rounded shaft surface 130 extending around a majority of shaft portion 104.

A distal end 132 of shaft portion 104 joins first portion 102. In one embodiment, shaft portion 104 is welded directly to first portion 102 at interface 112. In other embodiments, shaft portion 104 is adhered by an adhesive, bolted or otherwise fixed to the first portion 102. In preferred forms, adapter 100 including both first portion 102 and shaft portion 104 may be formed as a one piece configuration by means of a mold or extrusion.

Shaft portion 104 is generally aligned along Axis A (FIG. 1B) and includes one or more of a first connection portion 136 and a second connection portion 142. In the present embodiment, there are two of each of the first connection portions 136 and the second connection portions 142 spaced apart and on opposing sides of shaft portion 104. In this embodiment, first connection portion 136 is in the form of an indentation on shaft surface 130 of shaft portion 104. First connection portion 136 is dimensioned to accommodate a standard hammer drill chuck. The first connection portion 136 includes spaced apart first end 138, and second end 140. The ends 138, 140 are generally rounded and adapted to cooperate with a hammer drill chuck 202 wherein when the hammer drill chuck 202 is locked on shaft portion 104, shaft portion 104 cannot escape when hammer drill 200 is operating.

Similarly, second connection portion 142 is in the form of an elongated slot formed on outer surface 130 of shaft portion 104. The slot of the connection portion 142 includes a closed end 144 and an open end 146. The slot of the connection portion 142 is configured to connect with the chuck of a hammer drill 200.

A bore 148 or small indentation may be provided at a proximal end of shaft portion 104. Bore 148 may also be adapted to connect directly to a hammer drill during use.

Figure 1B:
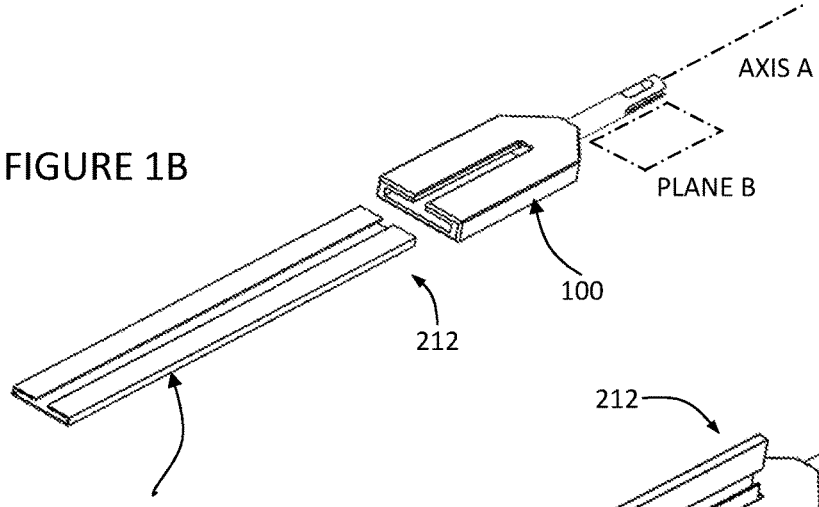
FIG. 1B depicts a perspective view of a trailing end of a drive cleat as it prepares to be housed within a capture cavity of an adaptor.
Figure 1C:
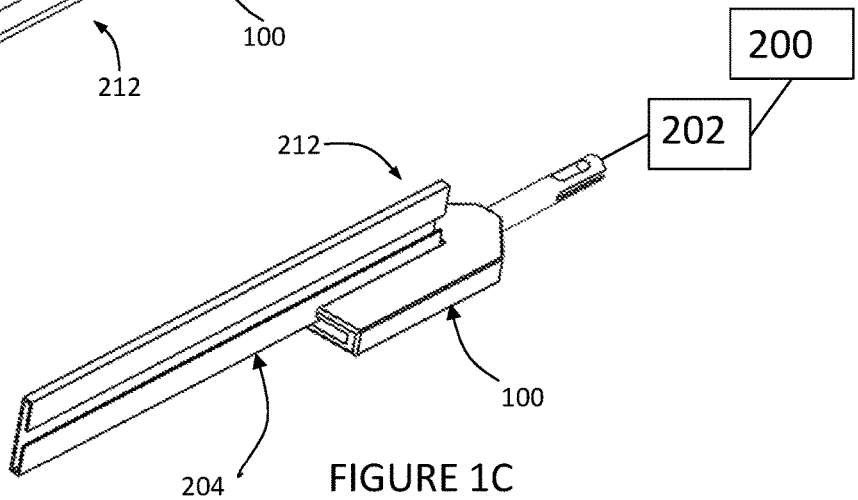
FIG. 1C depicts a perspective view of a trailing end of a drive cleat rotated 90 degrees and housed within a slot of a first portion of an adaptor.
Figure 2:
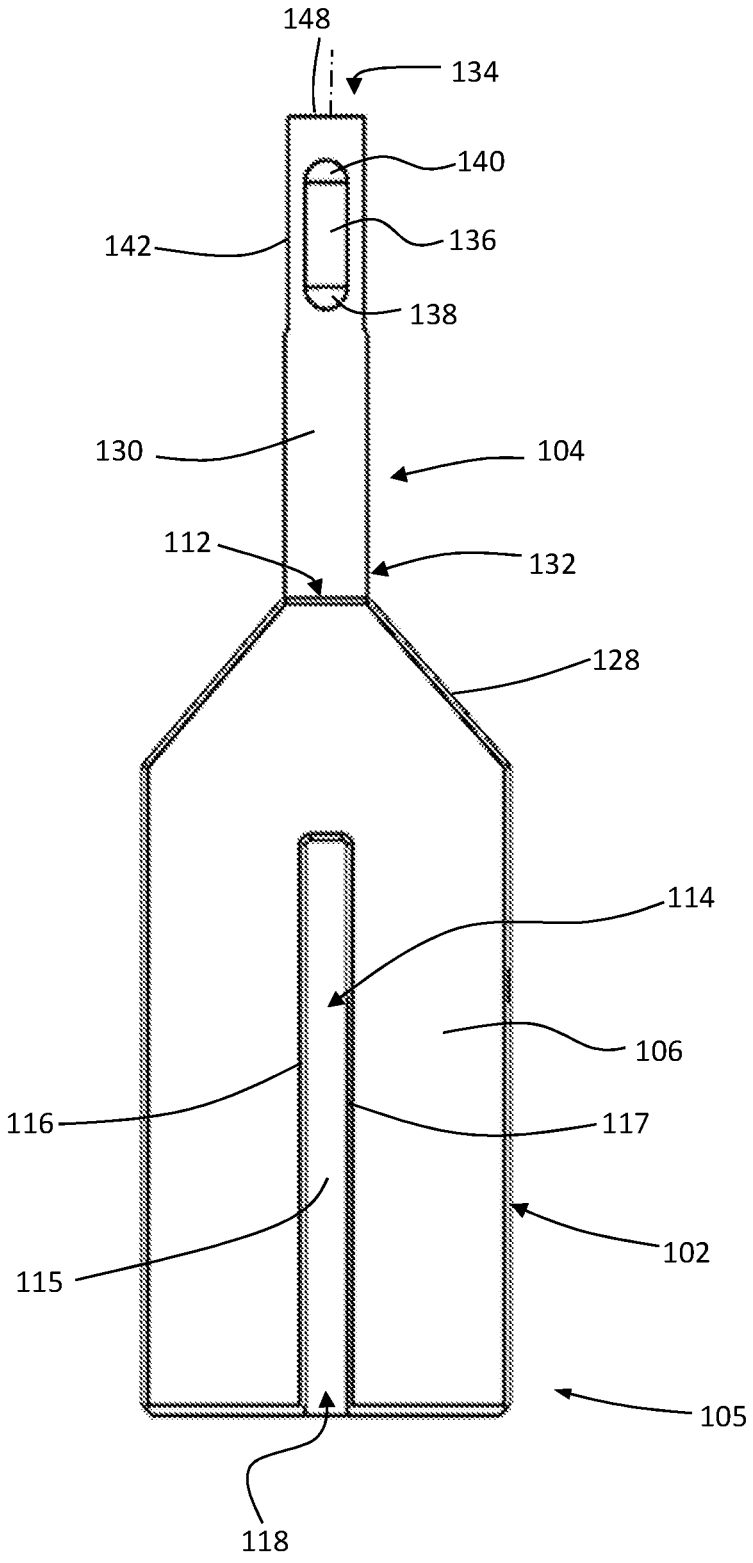
FIG. 2 depicts a elevational view of a drive cleat adaptor for connection to a hammer drill according to one or more embodiments shown and described herein.
Figure 3:
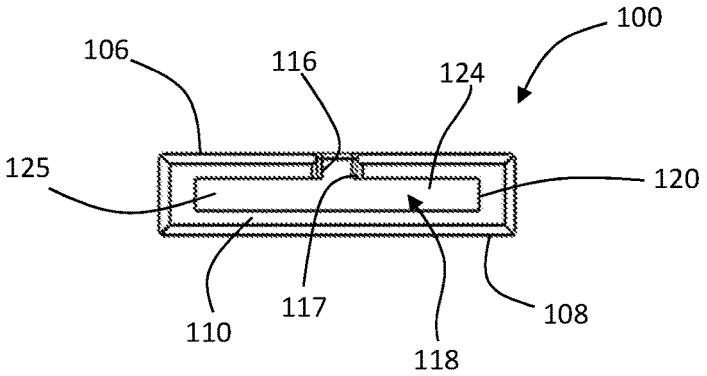
FIG. 3 depicts a distal end view of a drive cleat adaptor for connection to a hammer drill according to one or more embodiments shown and described herein.
Figure 4:
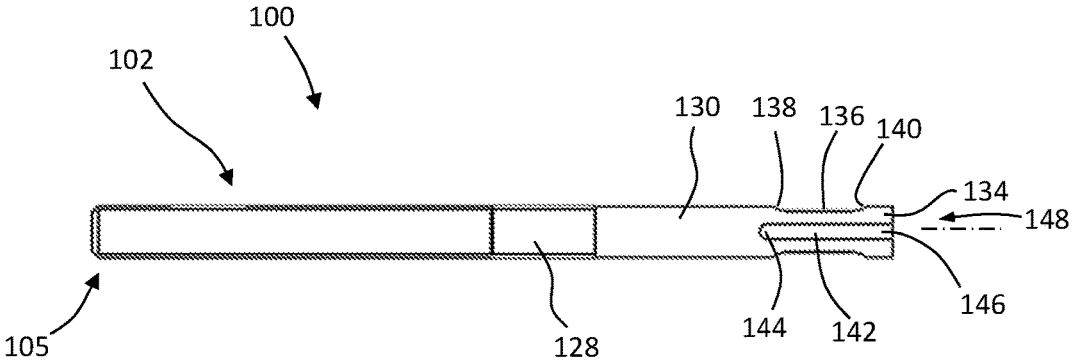
FIG. 4 depicts a side view of a drive cleat adaptor for connection to a hammer drill according to one or more embodiments shown and described herein.
Figure 5:
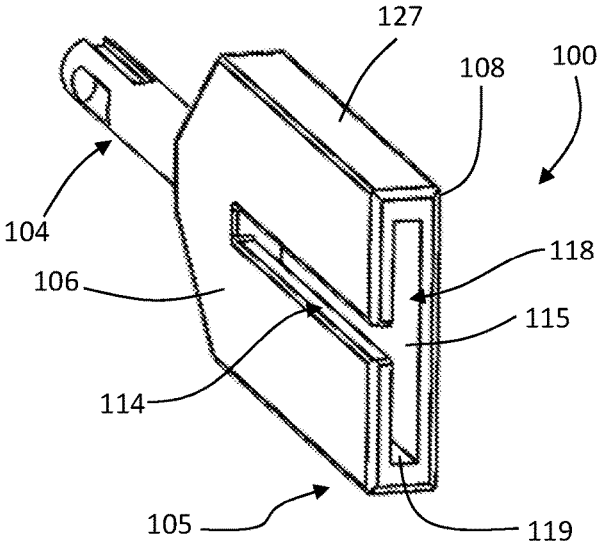
FIG. 5 depicts a perspective view of a drive cleat adaptor for connection to a hammer drill according to one or more embodiments shown and described herein.
Figure 5B:
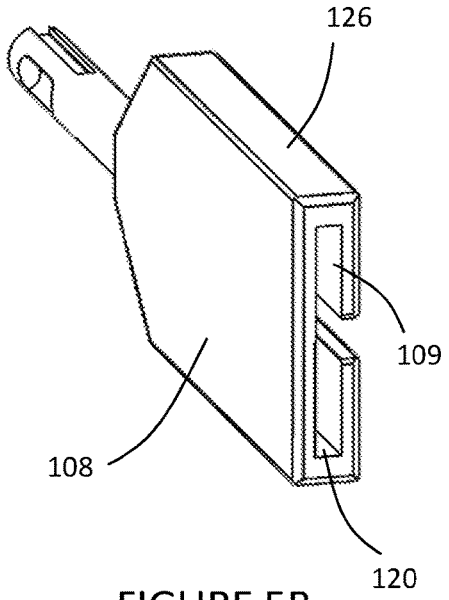
FIG. 5B depicts a perspective view of a drive cleat adaptor for connection to a hammer drill according to one or more embodiments shown and described herein.
Figure 6:
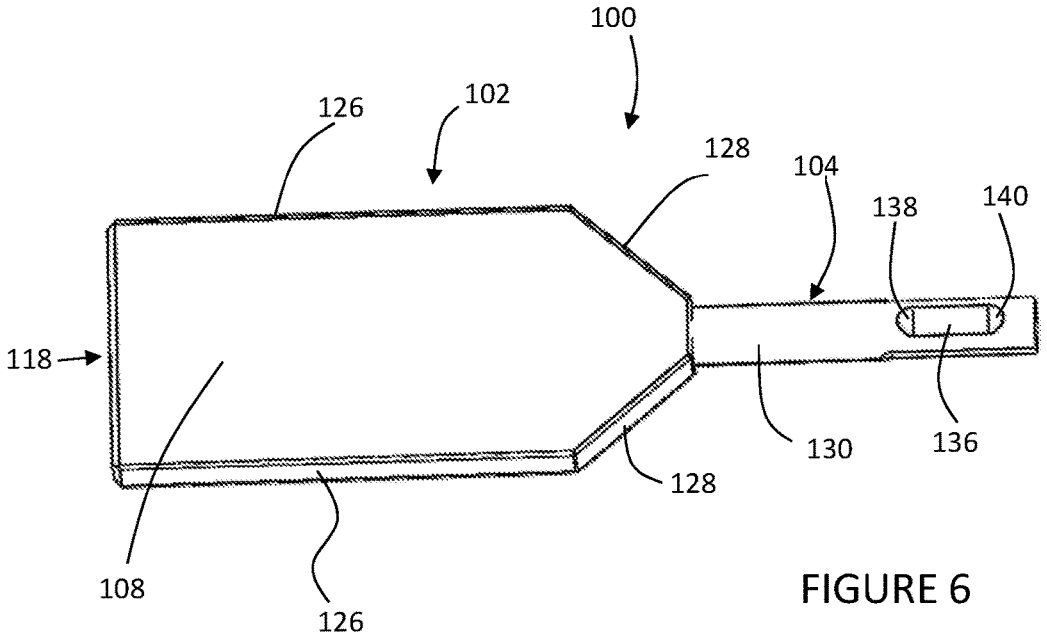
FIG. 6 depicts a perspective bottom view of a drive cleat adaptor for connection to a hammer drill according to one or more embodiments shown and described herein.
Figure 7:
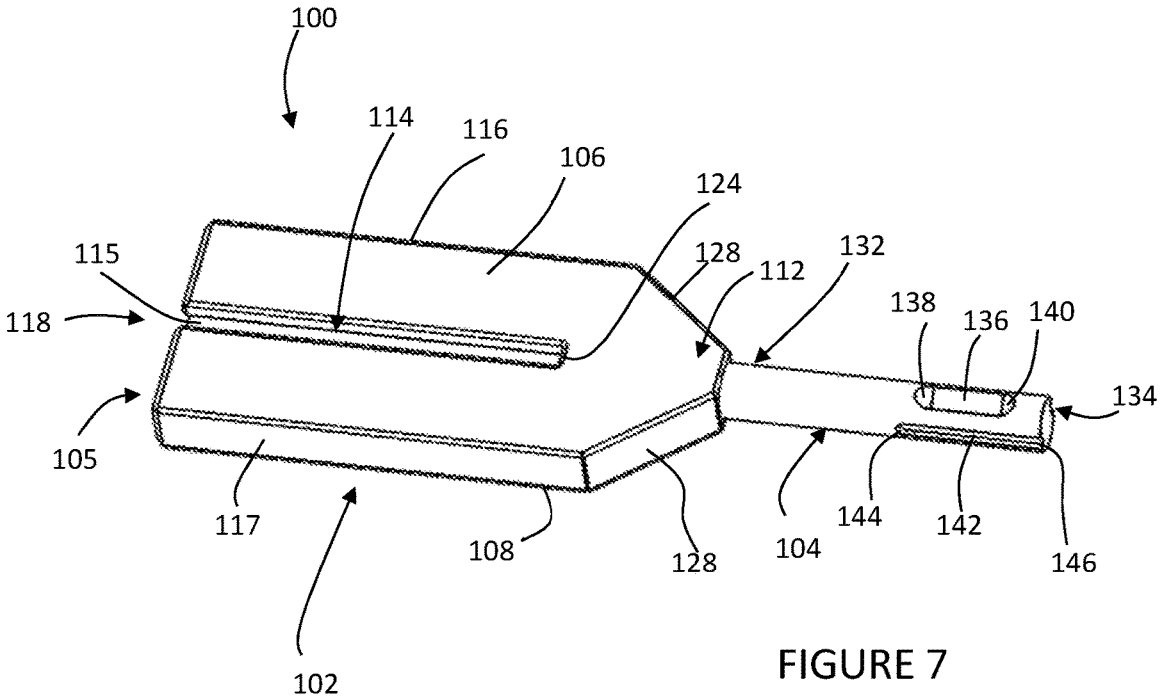
FIG. 7 depicts a perspective top view of a drive cleat adaptor for connection to a hammer drill according to one or more embodiments shown and described herein.

FIGS. 1 and 3 illustrate rear wall 124 having a generally planar rear surface 125 although this surface may be non-planar. During use, a drive cleat 204 abuts rear surface 125. The rear wall 124 and rear surface 125 are used to bias against an end portion of the drive cleat when in both the standard and rotated installation positions.

Figure 8:
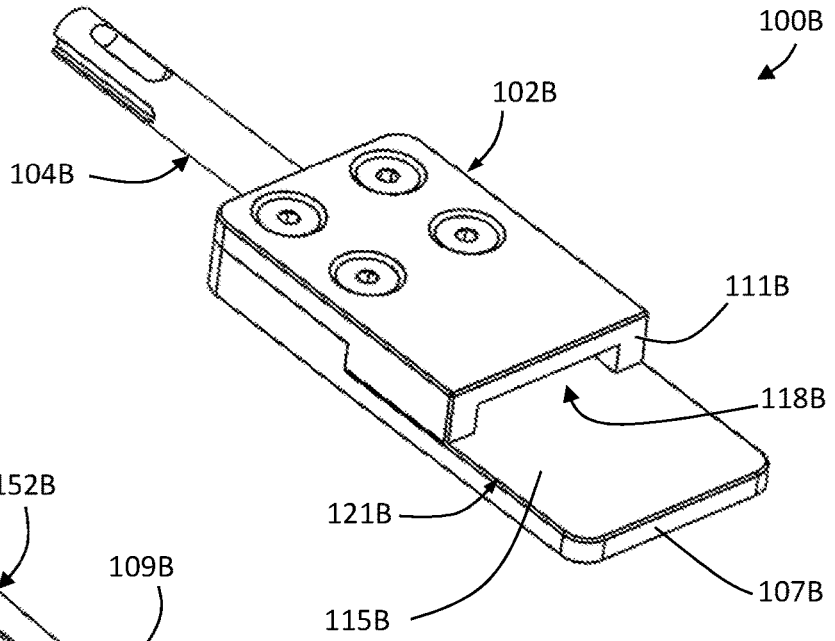
FIG. 8 depicts a perspective view of a drive cleat adaptor for connection to a hammer drill comprising a cover portion according to one or more embodiments shown and described herein.
Figure 9:
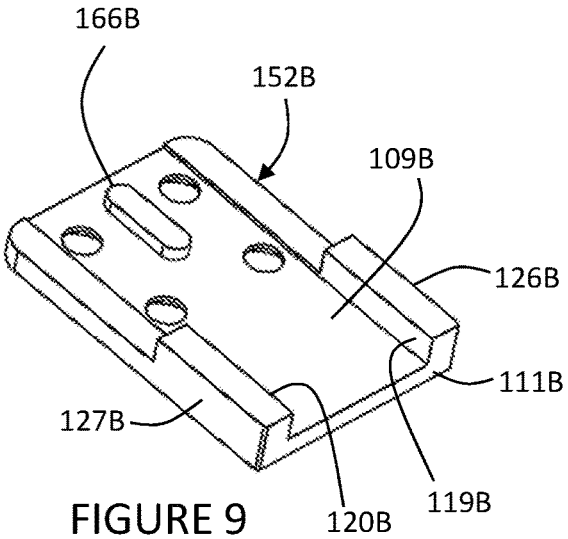
FIG. 9 depicts a perspective view of a cover portion of a drive cleat adaptor for connection to a hammer drill according to one or more embodiments shown and described herein.
Figure 10:
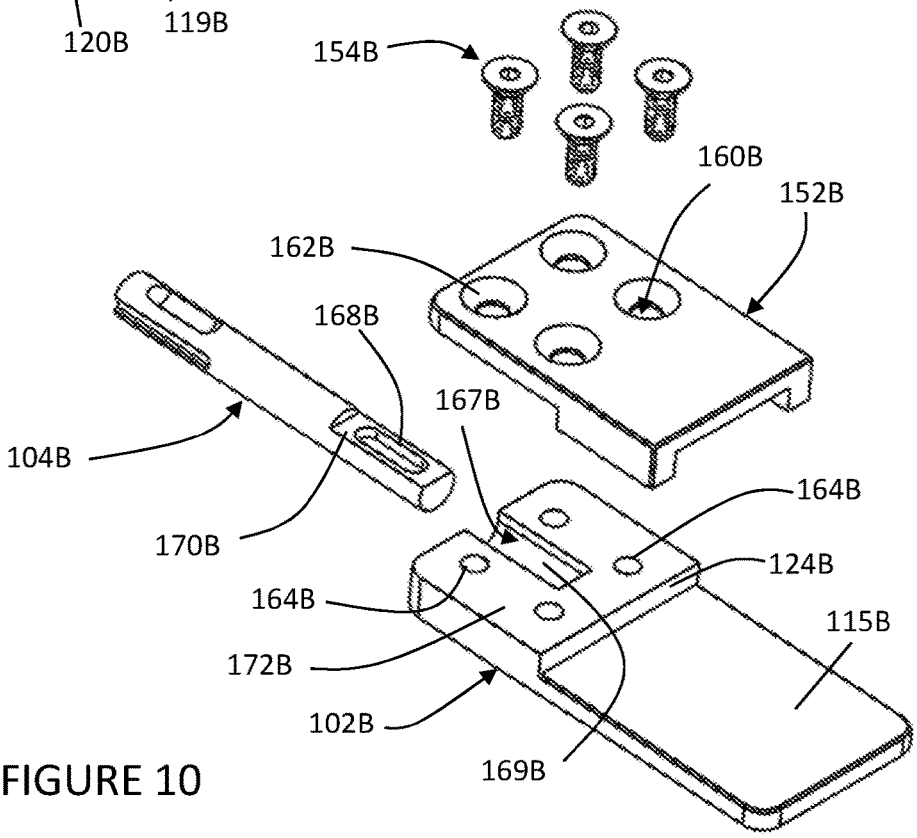
FIG. 10 depicts an exploded perspective view of a drive cleat adaptor for connection to a hammer drill according to one or more embodiments shown and described herein.

Illustrated in FIG. 8-10 is one form of adaptor 100B comprising an assembly of parts. An exploded view of this assembly is illustrated in FIG. 10. Adaptor 100B comprises a first portion 102B, a shaft portion 104B, a cover portion 152B, and one or more cover fasteners 154B. First portion 102B is divided in this embodiment to include a cover portion 152B that mates with first portion 102B to form capture cavity 118B. In this embodiment, a secondary surface 111B is positioned proximal from an entry surface 107B yet distal to a rear surface 124B. As, illustrated for this embodiment, secondary surface 111B is parallel to an entry surface 107B. As illustrated for this embodiment, a lower capture surface 115B is extended further distally than said upper capture surface 109B and first and second capture surfaces 119B,120B of a capture cavity 118B thereby defining a tongue portion 121B.

One or more cover fasteners 154B extend through fastener holes 160B to thread into threaded holes 164B extending through the body of first portion 102B. Fastener holes 160B may be counter sunk 162B. As illustrated in previous embodiments, a first capture surface 119B, a second capture surface 120B, a lower capture surface 115B, an upper capture surface 109B, and a rear surface 125B define capture space 118B for containing a drive cleat 204 therein. A distal end of shaft portion 104B is seated against channel surface 169B in shaft channel 167B. Upper capture surface 109B compresses against lock flat 170B when cover fasteners 154B are advanced. Cover portion 152B comprises a lock boss 166B extending from upper capture surface 109B which seats in lock recess 168B of shaft portion 104B when assembled to fix shaft portion 104B to first portion 102B.

Figure 11:
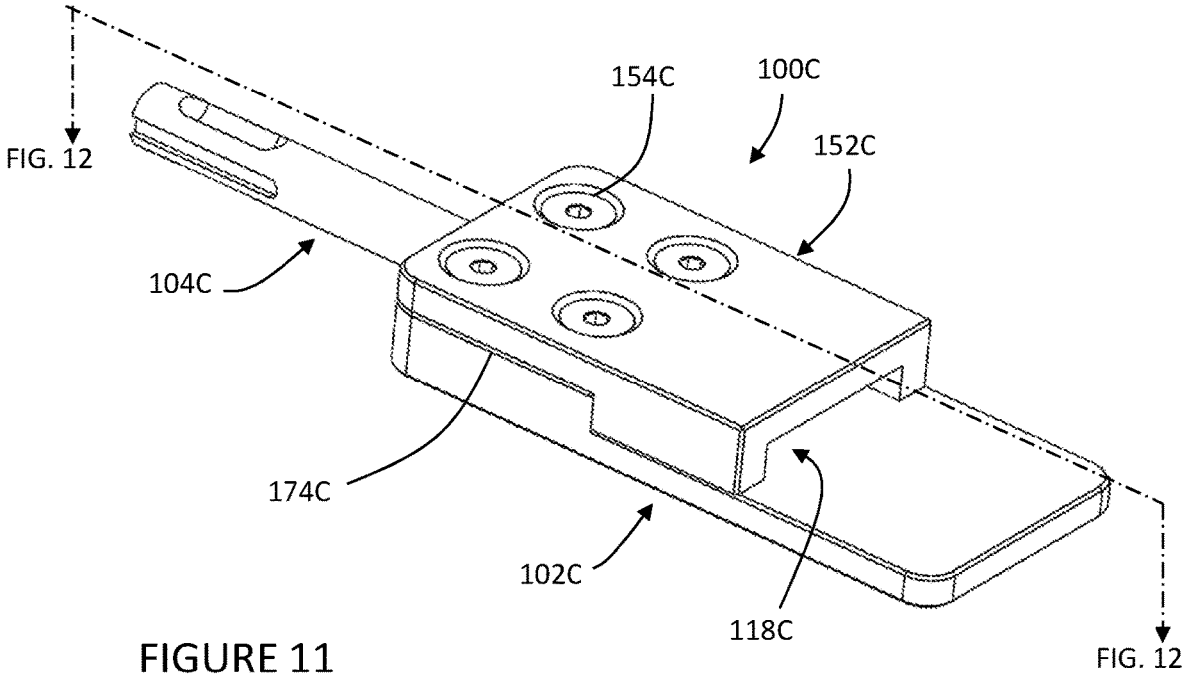
FIG. 11 depicts perspective view of a drive cleat adaptor for connection to a hammer drill having a drive cleat retension member in the form of a spring according to one or more embodiments shown and described herein.
Figure 12:
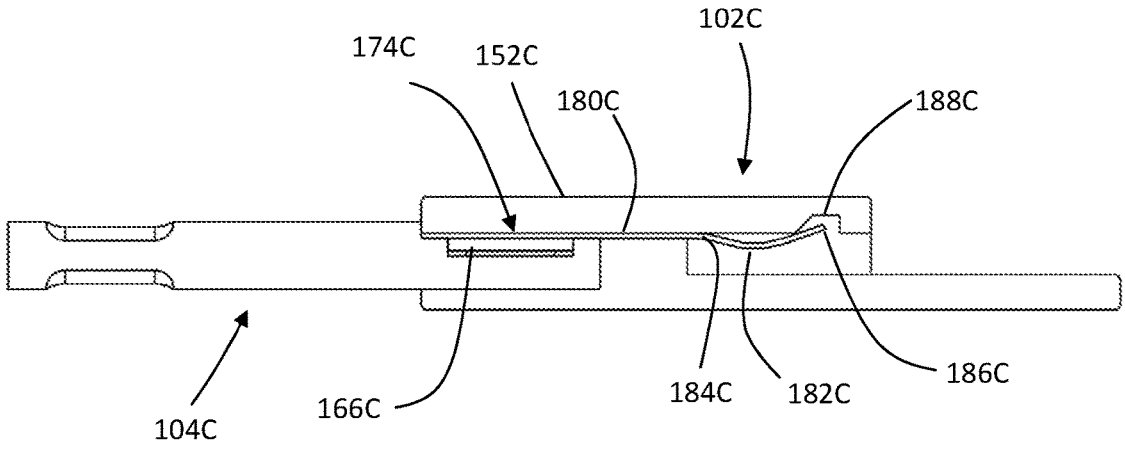
FIG. 12 depicts a cross sectional view of a drive cleat adaptor for connection to a hammer drill according to one or more embodiments shown and described herein.
Figure 13:
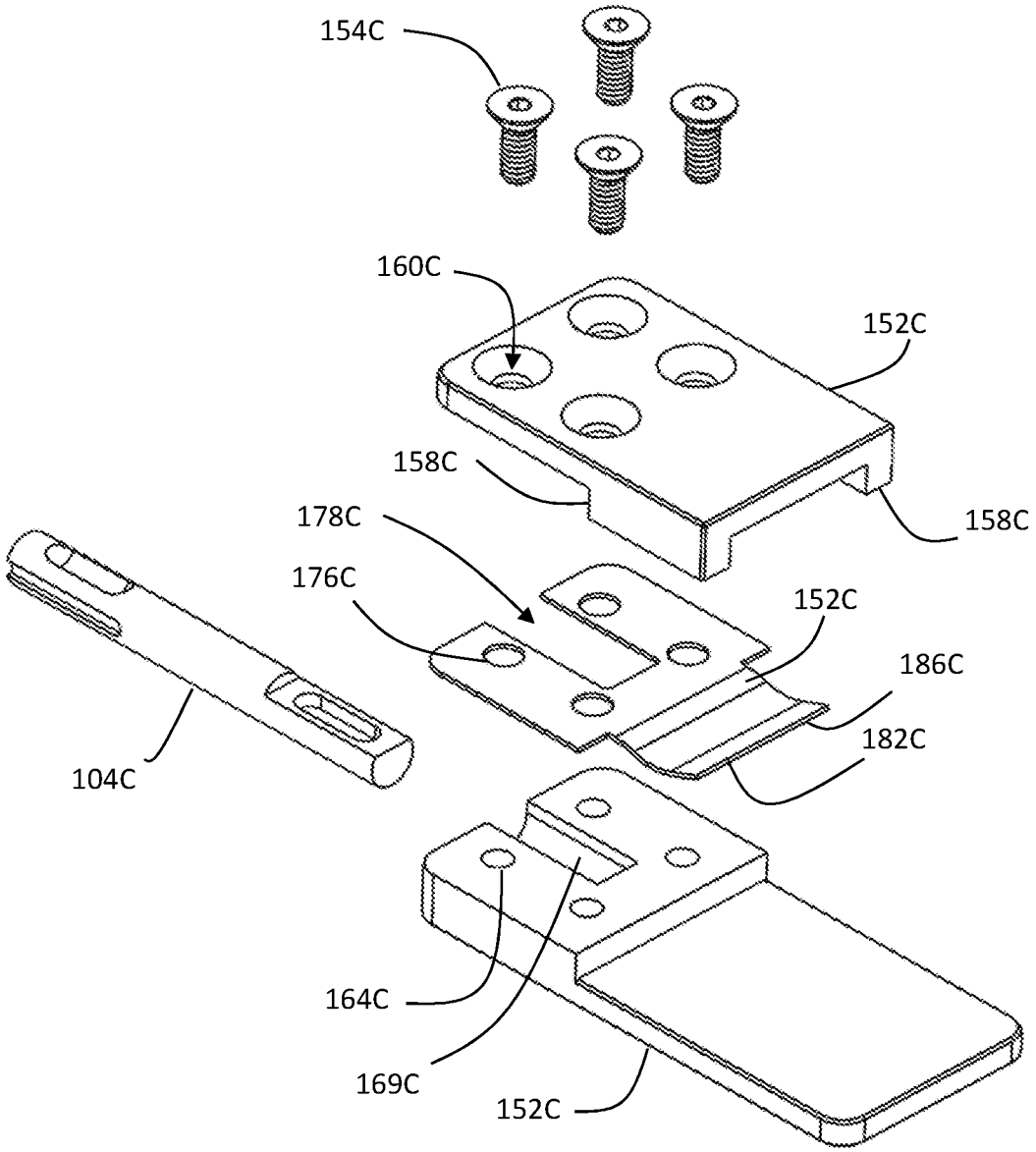
FIG. 13 depicts an exploded perspective view of a drive cleat adaptor having a drive cleat retension member in the form of a spring for connection to a hammer drill according to one or more embodiments shown and described herein.

FIG. 11-13 illustrates an adaptor 100C embodiment functionally the same as illustrated previously in FIG. 8-10 with the addition of a drive cleat retension member. A drive cleat retension member adds the additional functional benefit of releasably holding a drive cleat in a capture cavity thereby preventing unintentional drop out of the drive cleat from the capture cavity if the user tilts the hammer drill to the side or downwards for any reason. In this embodiment, a spring foot 180C of spring 174C is sandwiched between upper capture surface 109C of cover portion 152C and lower capture surface 115C of first portion 102C. Spring foot 180C comprises one or more spring holes 176C for the passage of cover fasteners 154C. A spring cutaway 178C may be included for clearance of lock boss 166C. Extending from spring foot 180C is distal portion of spring 174C comprising a deflection arm 184C with a contact face 182C for abutting against drive cleat 204 to create a friction fit within capture cavity 118C. The spring force through deflection arm 184C is sufficient to hold drive cleat 204 within capture cavity 118C against gravity, however the drive cleat 204 is easily removed when a distraction force is applied by a user. An elongate spring channel 188C may be formed in cover portion 152C to house spring end 186C thereby preventing interference between a drive cleat and the spring end 186C during drive cleat insertion into capture cavity 118C. The drive cleat retension member may assume other resilient forms such as springs of various shapes and configurations and elastomeric materials such as a rubber or foam pad.

Figure 14:
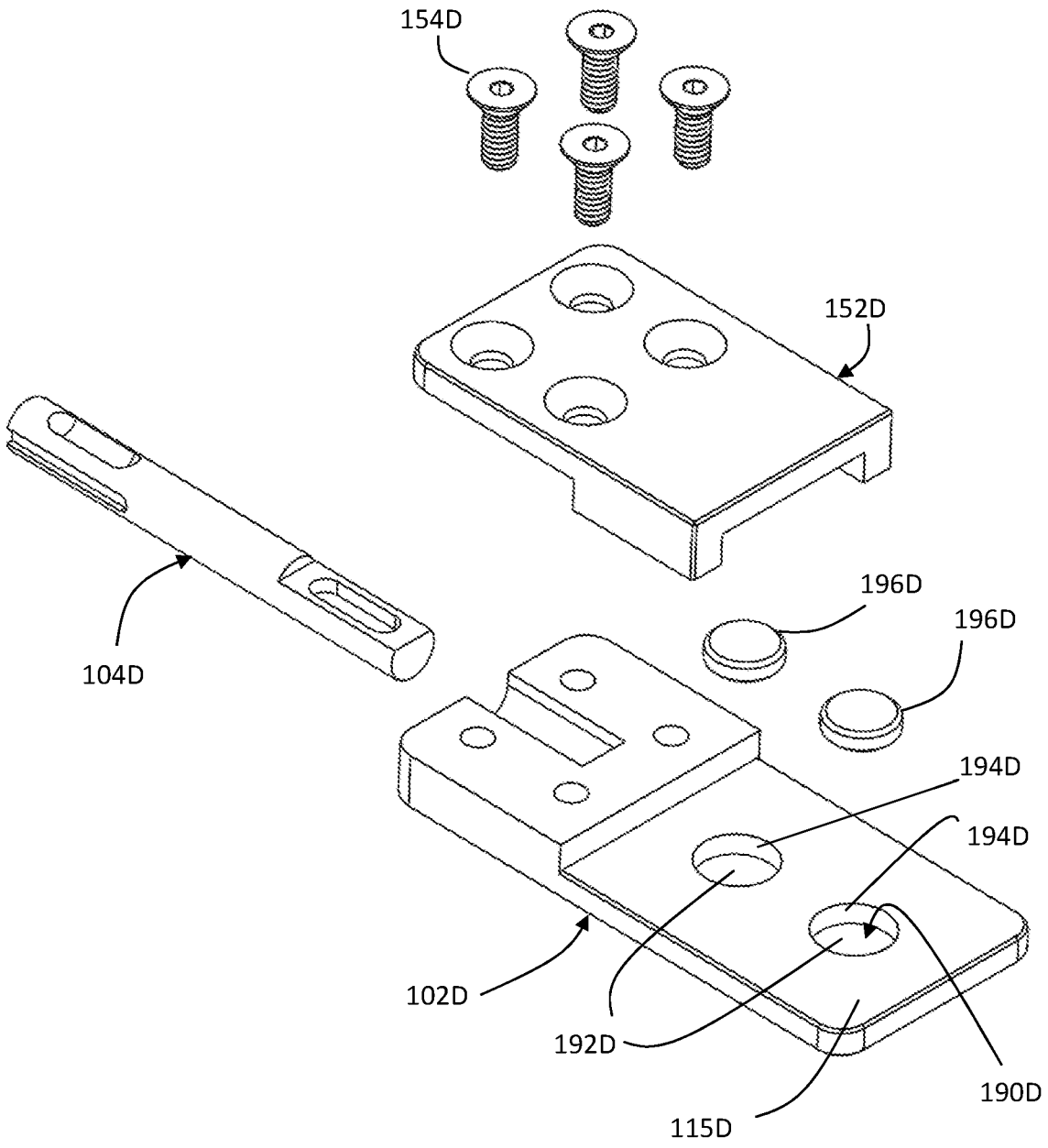
FIG. 14 depicts an exploded perspective view of a drive cleat adaptor having a drive cleat retension member in the form of one or more magnets according to one or more embodiments shown and described herein.

FIG. 14 illustrates an adaptor 100D embodiment also functionally the same as illustrated previously in FIGS. 8-9 and with the addition of a drive cleat retension member in the form of one or more magnets 196D. In this embodiment, one or more magnet bores 190D extend into lower capture surface 115D of first portion 102D. Magnet bores 190D are defined by one or more of a base face 192D and a position face 194D. Magnet bores 190D in this embodiment are sized and shaped to accommodate disc shaped magnets 196D. In some embodiments, magnets 196D are held in position by adhesives. Magnets 196D and cooperating magnet bores 190D may assume a variety of shapes and sizes. Alternatively, the magnet bores 190D may be formed in other surfaces defining a capture cavity 118C such as within an upper capture surface 109D of cover portion 152D. Upon insertion of a drive cleat 204 of a material such as steel into capture cavity 118D, the one or more magnets 196D are magnetically attracted to the drive cleat 204 causing it to be held within the capture cavity 118D against gravity. The drive cleat 204 may be removed with a translation force by the user.

Figure 15:
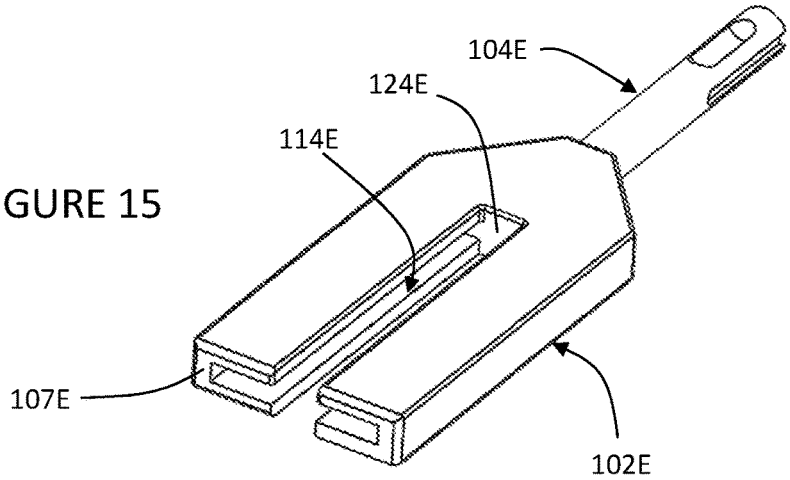
FIG. 15 depicts a perspective view of a drive cleat adaptor having a slot extending entirely through a first portion according to one or more embodiments shown and described herein.
Figure 16:
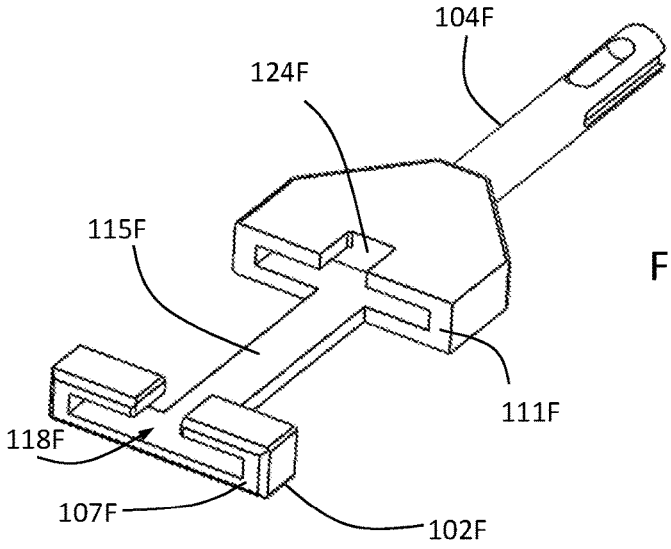
FIG. 16 depicts perspective view of a drive cleat adaptor having a capture cavity that is only substantially enclosed at a distal and proximal ends of a capture cavity according to one or more embodiments shown and described herein.
Figure 17:
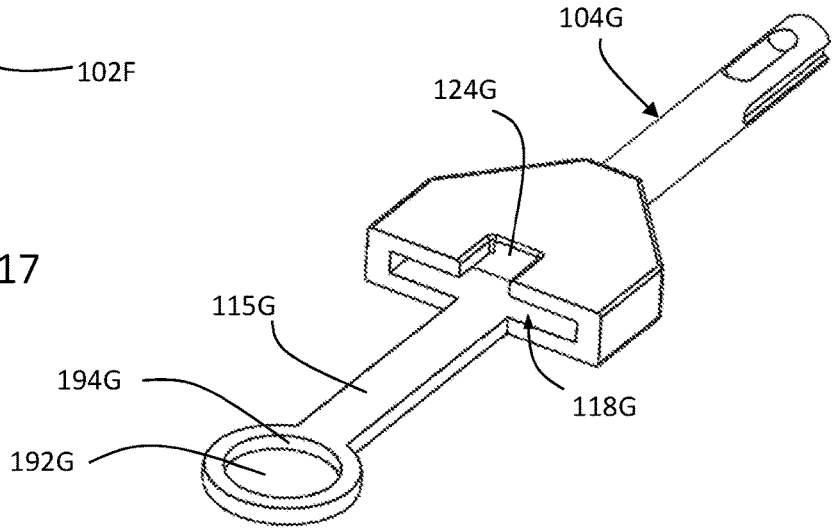
FIG. 17 depicts perspective view of a drive cleat adaptor whereby only the proximal end of a capture cavity is enclosed according to one or more embodiments shown and described herein.

FIGS. 15-17 illustrate further alternative embodiments of drive cleat adaptors wherein the space defining a capture cavity may have various degrees of enclosure. For example, FIG. 15 illustrates a slot portion 114E which extends entirely through the first portion 102E of adaptor 100E. FIG. 16 illustrates an embodiment wherein a capture cavity 118F is only substantially enclosed at a distal and proximal ends of the capture cavity. FIG. 17 illustrates an embodiment of an adaptor 100G whereby only the proximal end of a capture cavity 118G is enclosed. A magnet bore 190G houses a robust magnet that substantially controls the position of a drive cleat by means of magnetic attraction.

Adaptor 100, including both first portion 102 and shaft portion 104, may be made of any suitable metal having sufficient strength and resiliency to withstand the force from both the hammer drill and the drive cleat. The adaptor 100 may be made from steel, aluminum or any other suitable metal or alloy. Alternatively, adaptor 100 may be a plastic, polymer or rubber material or combination of materials so long as said material has sufficient strength and resiliency to withstand the force from both the hammer drill and the drive cleat.

Figure 18:
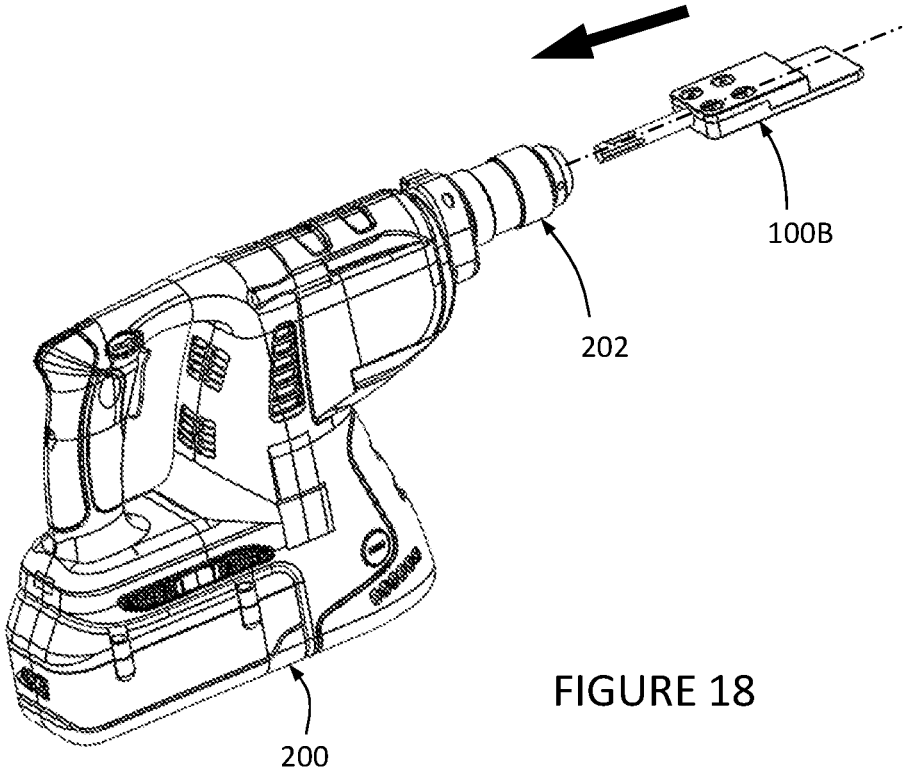
FIG. 18 depicts a perspective view of a hammer drill as a hammer drill adapter is about to be inserted according to one or more embodiments shown and described herein.
Figure 19:
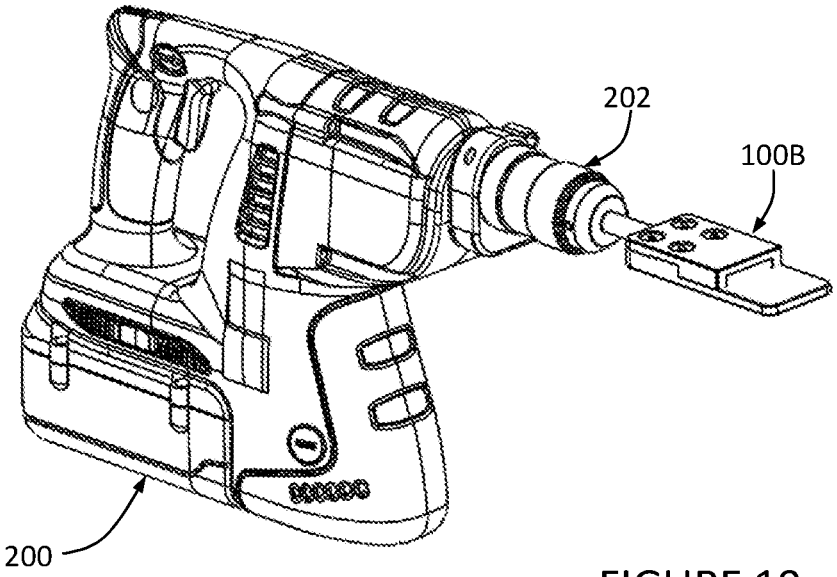
FIG. 19 depicts a perspective view of the hammer drill with hammer drill adaptor housed within a hammer drill chuck according to one or more embodiments shown and described herein.
Figure 20:
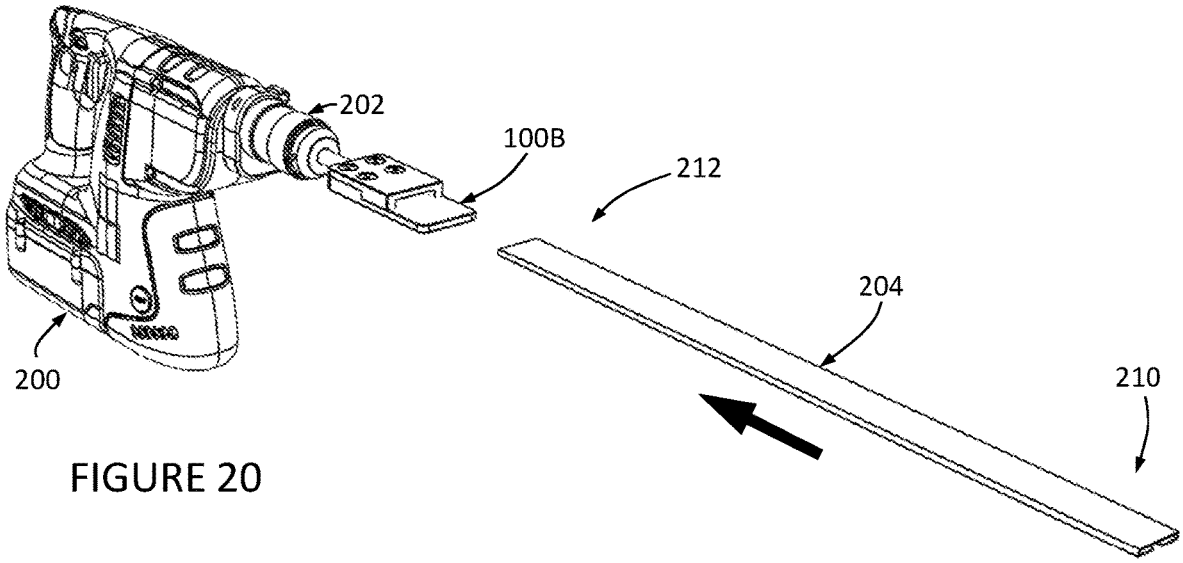
FIG. 20 depicts a perspective view of the drive cleat of FIG. 19 about to be inserted into a capture cavity of a hammer drill adapter according to one or more embodiments shown and described herein.
Figure 21:
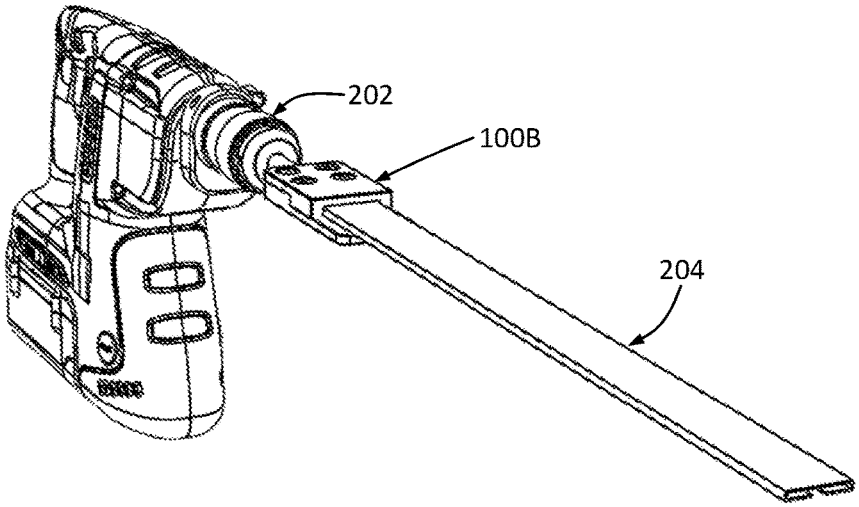
FIG. 21 depicts a perspective view of the drive cleat of FIG. 19 fully inserted in a hammer drill adaptor according to one or more embodiments shown and described herein.
Figure 22:
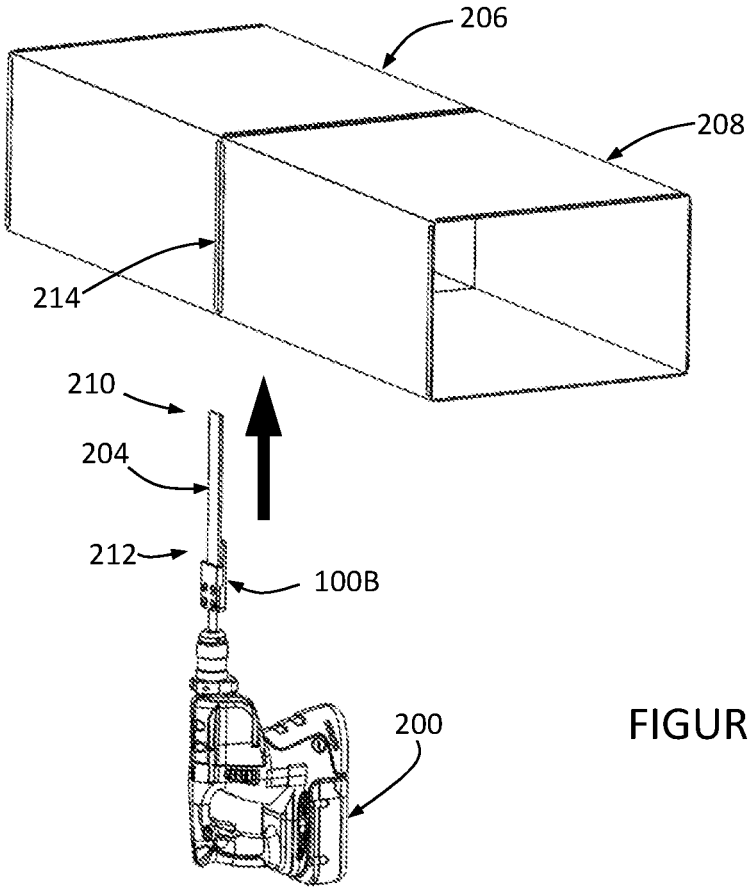
FIG. 22 depicts a perspective view of the drive cleat of FIG. 19 preparing to join a duct seam according to one or more embodiments shown and described herein.

FIGS. 18 through 26 illustrate one embodiment of a method of using an adapter 100B with a hammer drill 200 to join seams 214 between a first duct 206 and a second duct 208 using a drive cleat 204. As illustrated in FIG. 18-19, an adapter 100B is installed and releasably fixed in a hammer drill chuck 202 of hammer drill 200. Adapter 100B is configured, such as previously described, to couple with a first end 212 of a drive cleat 204 as illustrated in FIG. 20-21. A second end 210 of a drive cleat 204 is configured to mount directly to the ducts 206, 208 at seam 214. The user installs adapter 100B in hammer drill 200 and subsequently couples adapter 100B directly with drive cleat 204 at first end 212. A second end 210 of drive cleat 204 is coupled directly with flanges at seam 214 of ducts 206, 208 (FIG. 22). The user begins operation of the hammer drill 200 to force drive cleat 204 into the seam 214 to securely connect the ducts 206, 208 together.

Figure 23:
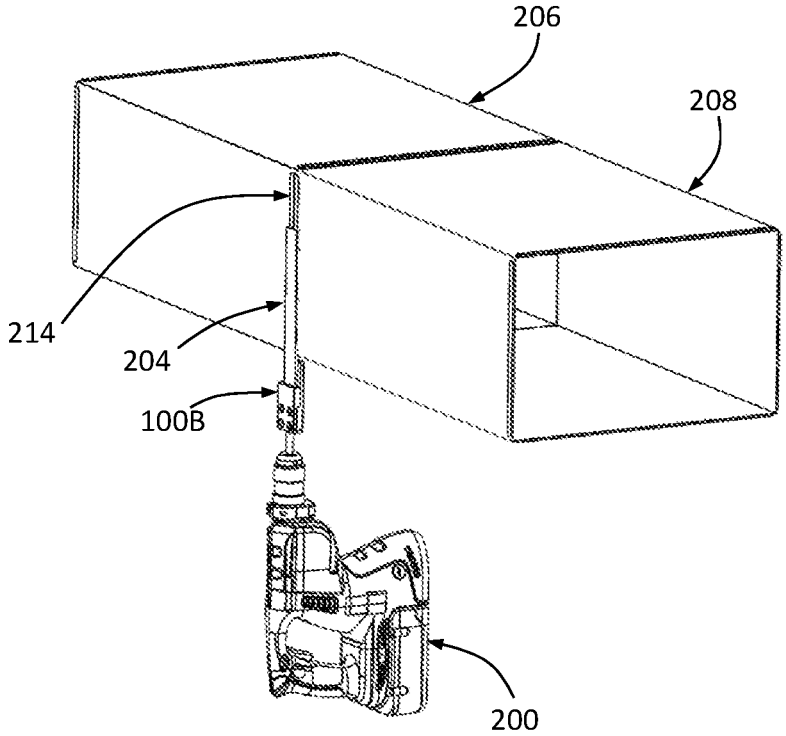
FIG. 23 depicts a perspective view of the drive cleat of FIG. 19 partially engaged at a duct seam according to one or more embodiments shown and described herein.

FIG. 23 illustrates an almost complete installation of the drive cleat 204 between the ducts 206, 208. The first end 212 of the drive cleat 204 is in a standard installed position where the capture cavity 118B of adapter 100B is sufficiently positioned around first end 212 of drive cleat 204.

Conversely, an adapter 100 may be rotated 90 degrees with respect to the position as illustrated in FIG. 1C. In this configuration of use, first end 212 of drive cleat 204 may be installed within the slot 114 of adapter 100. The user can then finish installation of the drive cleat 204 within seam 214. Inclusion of slot 114 and the modified installation configuration enables the user to further push the drive cleat into position.

Figure 24:
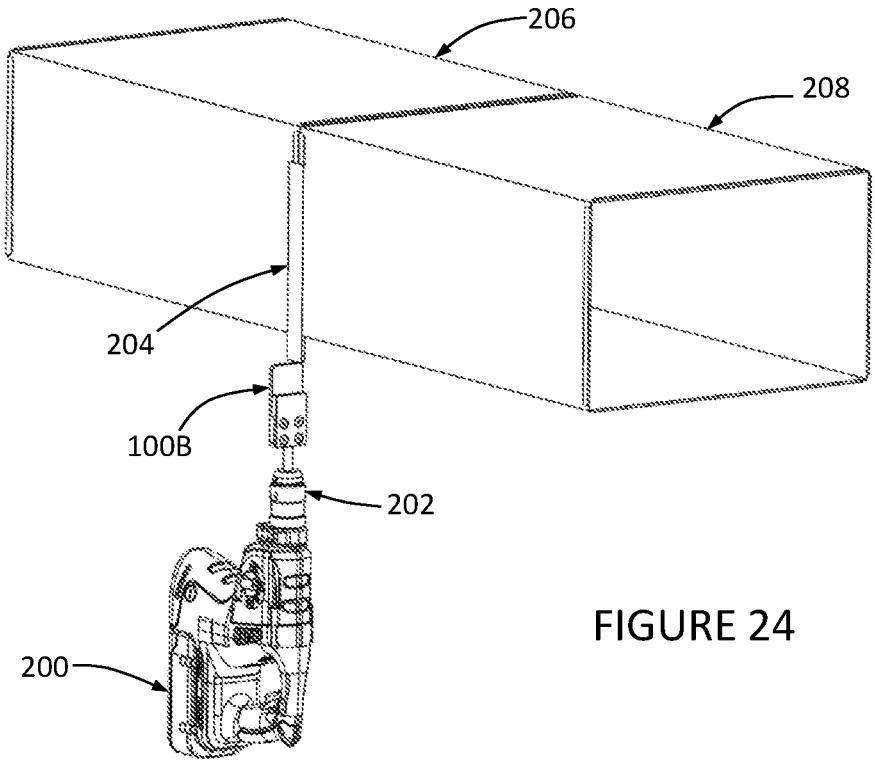
FIG. 24 depicts a perspective view of the drive cleat of FIG. 19 being driven by a terminal end of a hammer drill adaptor according to one or more embodiments shown and described herein.
Figure 25:
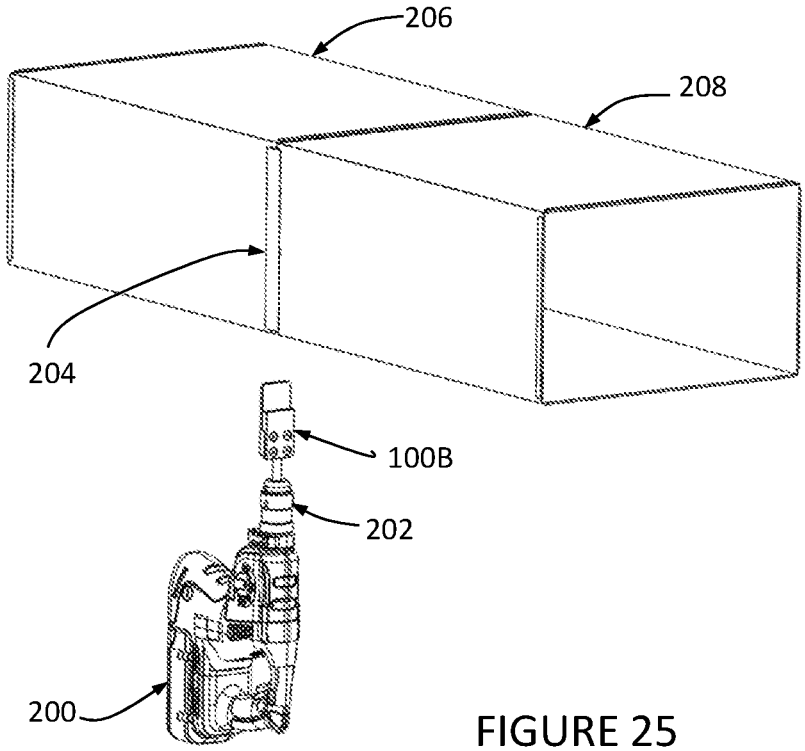
FIG. 25 depicts a perspective view of the drive cleat of FIG. 19 fully installed and the tools being removed according to one or more embodiments shown and described herein.

Alternatively, the user may position distal end 105B of the first portion 102B of adapter 100B against a distal end of first end 212 of drive cleat 204 as illustrated in FIG. 24. In this configuration, surface 107B is positioned directly adjacent to a distal end of first end 212 of drive cleat 204 so as to exert a force against the far distal end of the first end 212 of the drive cleat 204. This configuration allows the user to gently tap the drive cleat 204 into a final installed position. Once the drive cleat is seated in it predetermined position, adaptor 100B and hammer drill 200 may be removed as illustrated in FIG. 25.

Figure 26:
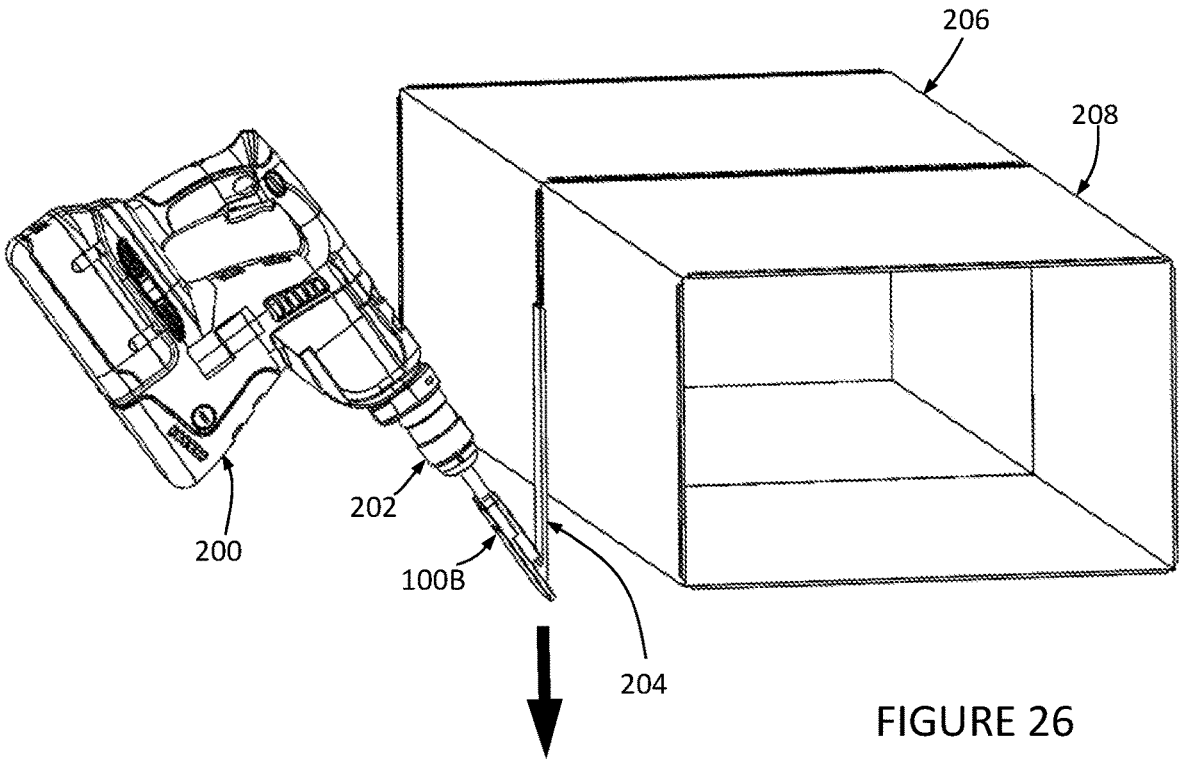
FIG. 26 depicts a perspective view of a technique for removal of a drive cleat according to one or more embodiments shown and described herein.

In a removal step, first end 212 of drive cleat 204 is bent back on itself. First end 212 is then coupled within capture cavity 118B as illustrated in FIG. 26. Activating the hammer drill 200, drive cleat 204 is removed.

The present specification provides the distinct advantage in that a user can easily and quickly install a drive cleat using a hammer drill. The user is no longer merely relegated to a standard hammer. Significant time is saved by the user during a typical installation.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A hammer drill adapter for driving a drive cleat to join air ducts comprising:

a first portion of said hammer drill adapter aligned in a plane;

a shaft portion having an elongate axis parallel to said plane;

said shaft portion extending proximally from a proximal end of said first portion;

said first portion fixed to said shaft portion;

a distally facing entry surface at a distal end of said first portion;

a distally facing secondary surface positioned proximal from said entry surface;

a rectangular capture cavity extending proximally through said secondary surface into said first portion;

said capture cavity defined proximally by a rear surface facing the distal end of said hammer drill adapter;

said capture cavity defined by a lower capture surface opposed and facing an upper capture surface;

said lower capture surface spaced from said upper capture surface;

a tongue portion of said first portion extending distally from said secondary surface to said entry surface;

said capture cavity laterally defined by a first capture surface opposed and facing a second capture surface;

said first capture surface spaced from said second capture surface;

said capture cavity sized to house an entire end portion of a drive cleat therein;

said shaft portion comprising a first connection portion at a proximal end of said shaft portion for fixation within a hammer drill chuck;

said first connection portion in the form of an elongate indentation;

wherein said first connection portion elongate indentation is closed at both ends; said lower capture surface extending distally over said tongue portion; said lower capture surface on said tongue portion having a width extending at least between said first capture surface and said second capture surface.

2. The hammer drill adapter of claim 1 further comprising:

a second connection portion on a proximal end of said shaft portion;

said second connection portion in the form of an elongate slot;

and wherein said second connection portion elongate slot is open at one end.

3. The hammer drill adapter of claim 1 wherein said shaft portion is configured for releasable locking within a hammer drill chuck.

4. The hammer drill adapter of claim 1 wherein said hammer drill adapter is formed in a mold.

5. The hammer drill adaptor of claim 1 wherein said first portion and said shaft portion is a single unified part.

6. The hammer drill adapter of claim 1 wherein said capture cavity is defined by a lower capture surface and a rear surface of said first portion, and by an upper capture surface and opposed first capture surface and second capture surface of a cover portion.

7. The hammer drill adapter of claim 1 further comprising a magnet bore extending at least partially into a surface defining said capture cavity.

8. The hammer drill adapter of claim 7 further comprising a magnet fixed within said magnet bore.

9. The hammer drill adaptor of claim 1 further comprising a drive cleat retension member for releasably securing a drive cleat.

10. The hammer drill adaptor of claim 9 wherein said drive cleat retension member is in the form of a spring extending into said capture cavity.

11. The hammer drill adaptor of claim 10 wherein said spring comprises a contact face for abutting against said drive cleat occupying said capture cavity.

12. The hammer drill adaptor of claim 9 wherein said drive cleat retension member is in the form of a magnet to magnetically secure a drive cleat to said hammer drill adapter.

13. A method of using a hammer drill adaptor to install a drive cleat to join air ducts comprising the steps of:

obtaining adjacent air ducts;

obtaining a drive cleat operable to join said adjacent air ducts;

obtaining a hammer drill having a hammer drill chuck;

obtaining a hammer drill adapter having a shaft portion and a first portion wherein said shaft portion extends proximally from a proximal end of said first portion and wherein said first portion has a rectangular shaped capture cavity extending proximally from a secondary surface of said hammer drill adaptor and wherein said capture cavity terminates at a distally facing rear surface, and wherein a tongue portion of said first portion extends distally from one side of the rectangular shaped capture cavity and terminates at a distally facing entry surface;

securing a portion of said shaft portion of the hammer drill adapter in the hammer drill chuck;

inserting one end of said drive cleat into said capture cavity until a terminal end of the drive cleat abuts said rear surface of said drive cleat at a proximal end of said capture cavity;

positioning the hammer drill with drive cleat seated in the capture cavity to a seam of adjacent air ducts;

joining the leading end of the drive cleat to the seam of the adjacent air ducts;

actuating the hammer drill to exert a plurality of pulses to said rear surface of said hammer drill adapter thereby driving said drive cleat into an installed position wherein said adjacent air ducts are joined together by said drive cleat; and removing said hammer drill and said hammer drill adapter from said drive cleat.

14. The method of using a hammer drill adaptor to install a drive cleat to join air ducts of claim 13 further comprising the step of a user advancing said hammer drill adapter by application of a force along a central axis of said shaft portion.

15. The method of using a hammer drill adaptor to install a drive cleat to join air ducts of claim 13 wherein the step of securing said shaft portion of the hammer drill adaptor in the hammer drill chuck further comprises the step of engaging said hammer drill chuck within a first connection portion comprising an indentation of the shaft surface of said shaft portion whereas said indentation has an enclosed first end and enclosed second end.

16. The method of using a hammer drill adaptor to install a drive cleat to join air ducts of claim 13 wherein the step of securing said shaft portion of the hammer drill adaptor in the hammer drill chuck further comprises the step of engaging said hammer drill chuck within a second connection portion comprising an elongate slot on an outer surface of said shaft portion whereas said elongate slot has an open end and a closed end.

17. A hammer drill adapter for driving a drive cleat to join air ducts comprising:

a first portion of said hammer drill adapter aligned in a plane;

a shaft portion of said hammer drill adapter having an elongate axis parallel to said plane;

said first portion fixed to said shaft portion;

said shaft portion extending proximally from a proximal end of said first portion;

a distally facing entry surface at a distal end of said first portion;

a distally facing secondary surface positioned proximal from said entry surface;

a rectangular capture cavity extending proximally through said entry surface into said first portion;

said capture cavity defined proximally by a distal facing rear surface;

said capture cavity defined by an opposed lower capture surface and an upper capture surface;

said lower capture surface spaced from said upper capture surface;

said capture cavity laterally defined by an opposed first capture surface and a second capture surface;

said first capture surface spaced from said second capture surface;

said capture cavity sized to house an entire end portion of a drive cleat therein;

said shaft portion comprising a first connection portion at a proximal end comprising an indentation of the shaft surface;

said indentation having an enclosed first end and enclosed second end for fixation within a hammer drill chuck;

an elongate slot generally parallel to said elongate axis;

said elongate slot extending from said entry surface to said rear surface;

said elongate slot extending between said upper capture surface of said capture cavity and an upper surface on outside of said first portion.

18. The hammer drill adaptor of claim 17 wherein said first portion and said shaft portion is a single unified part.

19. The hammer drill adapter of claim 17 wherein said hammer drill adapter is formed in a mold.

20. The hammer drill adapter of claim 17 further comprising a magnet bore extending at least partially into a surface defining said capture cavity.

* * * * *